US008827659B2

(12) United States Patent
Uno

(10) Patent No.: US 8,827,659 B2
(45) Date of Patent: Sep. 9, 2014

(54) OIL SUPPLY APPARATUS

(75) Inventor: Yoshito Uno, Anjo (JP)

(73) Assignee: Aisin Seiki Kabushiki Kaisha, Kariya-Shi, Aichi (JP)

( * ) Notice: Subject to any disclaimer, the term of this patent is extended or adjusted under 35 U.S.C. 154(b) by 0 days.

(21) Appl. No.: 13/878,626

(22) PCT Filed: Nov. 10, 2011

(86) PCT No.: PCT/JP2011/075994

§ 371 (c)(1),
(2), (4) Date: Apr. 10, 2013

(87) PCT Pub. No.: WO2012/077458

PCT Pub. Date: Jun. 14, 2012

(65) Prior Publication Data

US 2013/0209237 A1 Aug. 15, 2013

(30) Foreign Application Priority Data

Dec. 6, 2010 (JP) ..... 2010-271289

(51) Int. Cl.

| | |
|---|---|
| ***F04B 49/035*** | (2006.01) |
| ***F04D 29/06*** | (2006.01) |
| ***F04C 2/10*** | (2006.01) |
| ***F01M 1/16*** | (2006.01) |
| ***F04C 14/12*** | (2006.01) |
| ***F04C 14/08*** | (2006.01) |
| ***F04C 14/26*** | (2006.01) |

(52) U.S. Cl.

CPC ..... *F04D 29/06* (2013.01); *F04C 2210/206* (2013.01); *F04C 2/102* (2013.01); *F01M 1/16* (2013.01); *F04C 14/12* (2013.01); *F04C 14/08* (2013.01); *F04C 14/26* (2013.01)

USPC ..... 417/307; 417/310; 417/302

(58) Field of Classification Search

CPC ..... F04B 49/002; F04B 49/035; F04B 49/08; F04C 14/26; F04C 28/26

USPC ..... 417/213, 302, 300, 307, 310, 311; 418/15, 19, 180

See application file for complete search history.

(56) References Cited

U.S. PATENT DOCUMENTS 3,067,689 A * 12/1962 Hause ..... 417/288
3,788,770 A * 1/1974 Johnson et al. ..... 417/62

(Continued)

FOREIGN PATENT DOCUMENTS

EP 1 686 265 A2 8/2006
EP 1921317 A2 * 5/2008

(Continued)

OTHER PUBLICATIONS

International Preliminary Report on Patentability (PCT/IB/338) and English Translation of Written Opinion of the International Searching Authority (PCT/ISA/237) in the corresponding International Patent Application No. PCT/JP2011/075994.

(Continued)

*Primary Examiner* — Devon C. Kramer
*Assistant Examiner* — Alexander Comley
(74) *Attorney, Agent, or Firm* — Buchanan Ingersoll & Rooney

(57) ABSTRACT

In an oil supply apparatus, a valve body includes first and second radially protruding lands, and a small-diameter portion continuously connecting the first and second lands and having a diameter smaller than at least the outer diameter of the first and second lands. Rotational speeds of a rotor are set as first, second and third rotational ranges in the ascending order. In the first rotational range, work oil from a second discharge port is fed to a first oil passage via the small diameter portion. In the second rotational range, work oil from the second discharge port is fed to a return oil passage via the small diameter portion. In the third rotational range after the second oil passage is blocked relative to the return oil passage by the second land, work oil from the second discharge port is fed to the first oil passage.

6 Claims, 5 Drawing Sheets

(56) References Cited

U.S. PATENT DOCUMENTS

| | | | | |
|---|---|---|---|---|
| 4,222,712 | A * | 9/1980 | Huber et al. | 417/204 |
| 4,913,102 | A * | 4/1990 | Ohmura et al. | 123/41.12 |
| 5,547,349 | A * | 8/1996 | Kimura et al. | 417/282 |
| 5,669,761 | A * | 9/1997 | Kobayashi | 417/302 |
| 5,759,013 | A * | 6/1998 | Miyazaki et al. | 417/310 |
| 5,797,732 | A * | 8/1998 | Watanabe et al. | 417/310 |
| 6,004,111 | A | 12/1999 | Miyazaki et al. | |
| 6,086,337 | A * | 7/2000 | Watanabe et al. | 417/310 |
| 6,168,391 | B1 * | 1/2001 | Ono | 417/310 |
| 6,296,456 | B1 * | 10/2001 | Thornelow et al. | 417/310 |
| 6,478,549 | B1 * | 11/2002 | Aden et al. | 417/300 |
| 6,790,013 | B2 * | 9/2004 | Hunter et al. | 417/220 |
| 7,011,069 | B2 * | 3/2006 | Ono et al. | 123/196 R |
| 7,588,011 | B2 * | 9/2009 | Ono et al. | 123/196 R |
| 7,810,467 | B2 * | 10/2010 | Ono et al. | 123/196 R |
| 2005/0098385 | A1 * | 5/2005 | Ono et al. | 184/6.5 |
| 2006/0171818 | A1 * | 8/2006 | Kato | 417/302 |
| 2008/0105231 | A1 | 5/2008 | Ono et al. | |
| 2008/0190496 | A1 | 8/2008 | Ono et al. | |
| 2008/0253904 | A1 * | 10/2008 | Kai et al. | 417/310 |

FOREIGN PATENT DOCUMENTS

| | | | |
|---|---|---|---|
| JP | 10-318158 | A | 12/1998 |
| JP | 2001-165064 | A | 6/2001 |
| JP | 2005-140022 | A | 6/2005 |
| JP | 2008-115821 | A | 5/2008 |
| JP | 2008-223755 | A | 9/2008 |

OTHER PUBLICATIONS

Extended European Search Report dated Aug. 30, 2013, issued by the European Patent Office in the corresponding European Application No. 11847044.2. (6 pages).

International Search Report (PCT/ISA/210) issued on Feb. 14, 2012, by the Japanese Patent Office as the International Searching Authority for International Application No. PCT/JP2011/075994.

Written Opinion (PCT/ISA/237) issued on Feb. 14, 2012, by the Japanese Patent Office as the International Searching Authority for International Application No. PCT/JP2011/075994.

* cited by examiner

OIL SUPPLY APPARATUS

TECHNICAL FIELD

The present invention relates to an oil supply apparatus for use in e.g. lubrication of an automobile engine and controlling of a hydraulically controlled device.

BACKGROUND ART

For instance, in an automobile, work oil is employed for e.g. lubrication of an automobile engine, controlling of a hydraulically controlled device (a hydraulic control valve etc.). Such work oil is fed to respective parts of the automobile by an oil supply apparatus, and this oil supply apparatus includes a discharge amount varying arrangement capable of appropriately adjusting the discharge pressure of work oil in accordance with a rotational speed of the engine. An example of this type of oil supply apparatus is known from Patent Document 1 identified below.

The oil supply apparatus disclosed in Patent Document 1 includes a pump body having a suction port for suctioning work oil in association with rotation of a rotor which is driven in synchronism with a crank shaft as well as a first discharge port and a second discharge port that discharge work oil in association with the rotation of the rotor. In addition, this oil supply apparatus further includes a first oil passage for feeding at least work oil from the first discharge port to a work oil fed section, a second oil passage for feeding work oil from the second discharge port to the first oil passage, and a relief oil passage for feeding work oil from a hydraulic control valve including a valve body operable in response to oil pressure of the work oil to the first oil passage to at least one of the suction port and an oil pan.

In the oil supply apparatus described above, the valve body is provided with a first valve body oil passage and a second valve body oil passage. And, when the oil pressure of the work oil to the first oil passage is within a predetermined range, the work oil from the second discharge port is fed via the first valve body oil passage to the first oil passage; whereas when the oil pressure of the work oil to the first oil passage is above the predetermined range, the work oil from the second discharge port is fed via the second valve body oil passage to the first oil passage.

With the above arrangement wherein the work oil from the second discharge port can be fed via the first valve body oil passage to the first oil passage when the oil pressure of the work oil to the first oil passage is within the predetermined range, the feed amount of work oil to the first oil passage in this situation is the sum of the discharge amount of the first discharge port and the discharge amount of the second discharge port. As the rotational speed of the internal combustion engine increases and the rotational speed of the rotor increases, the amount of the work oil from the first discharge port alone becomes sufficient to ensure the necessary oil pressure. Then, it becomes unnecessary to combine the work oil from the first oil passage with the work from the second oil passage. In this case, the excess work oil in the second oil passage is returned to the relief oil passage without being fed to the first oil passage.

On the other hand, depending on the work oil fed component, feeding of a large amount of work oil becomes necessary when the rotational speed of the rotor is in a high speed range. For this reason, with this oil supply apparatus, the above-described arrangement is made such that when the oil pressure of the work oil to the first oil passage is above the predetermined range, the work oil from the second discharge port is fed via the second valve body oil passage to the first oil passage. In this, even after the feeding amount of work oil to the first oil passage consists of only the amount of work oil from the first discharge port, the feeding amount of work oil to the first oil passage can again comprise the sum of the discharge amount of the first discharge port and the discharge amount of the second discharge port. With this arrangement, even when the rotational speed of the rotor in a high speed range, it is still possible to increase the volume of work oil that can be fed, thus securing the necessary amount of oil to be fed to the work oil fed component.

PRIOR ART DOCUMENT

Patent Document

Patent Document 1: Japanese Unexamined Patent Application Publication No. 2005-140022

SUMMARY OF THE INVENTION

Object to be Achieved by Invention

With the engine oil supply apparatus of Patent Document 1, in order to feed work oil from the first discharge port and the second discharge port to the first oil passage and the relief oil passage according to the oil pressure applied to the hydraulic control valve, there is employed a hydraulic control valve having three radially protruding portions (a first valve portion, a second valve portion, and a separation member) disposed side by side along the axial direction of this hydraulic control valve. For this reason, the hydraulic control valve has a significant total length and it is needed to form the first discharge port and the second discharge port corresponding to the three radially protruding portions. Consequently, the oil supply apparatus is enlarged, so that the apparatus suffers high material cost as well as poor mountability due to restriction imposed on its disposing.

In view of the above-described problem, the object of the present invention is to provide a compact oil supply apparatus.

Means for Achieving the Object

According to a characterizing feature of an oil supply apparatus of the present invention for achieving the above-noted object, an oil supply apparatus comprises:

a pump body including a suction port for suctioning work oil in association with rotation of a rotor driven by a drive source, and a first discharge port and a second discharge port that discharge work oil in association with the rotation of the rotor;

a feed oil passage for feeding work oil to a work oil fed section;

a first oil passage for feeding at least work oil from the first discharge port to the feed oil passage;

a second oil passage for feeding work oil from the second discharge port to a valve chamber;

a return oil passage for returning work oil from the valve chamber to at least one of the suction port and an oil pan; and a hydraulic control valve having a valve body operable in response to the oil pressure of work oil fed to the feed oil passage for connecting/disconnecting the second oil passage to/from the first oil passage and the return oil passage;

wherein the valve body includes a first land and a second land that protrude along the radial direction of the valve body about the axis of the valve body, and a small diameter portion connecting the first land and the second land along the axial direction, the small diameter portion having a smaller diameter than at least the outer diameter of the first land and the second land;

rotational speeds of the rotor are set as a first rotational range, a second rotational range and a third rotational range in the ascending order;

at the time of the first rotational range, work oil from the second discharge port is fed via the small diameter portion to the first oil passage;

at the time of the second rotational range, the work oil from the second discharge port is fed via the small diameter portion to the return oil passage; and at the time of the third rotational range after the second oil passage is blocked relative to the return oil passage by the second land, the work oil from the second discharge port is fed to the first oil passage.

With the above-described characterizing arrangement, with the two lands, i.e. the first land and the second land, communication condition between the second oil passage, the first oil passage and the return oil passage can be controlled. Therefore, in comparison with a valve body having three or more lands, compactization is possible. Further, since the stroke of the valve body is made shorter in correspondence with such compactization of the valve body, compactization of the oil supply apparatus per se is also made possible. As a result, there can be realized an oil supply apparatus having good mountability.

Preferably, the outer diameter of the first land is larger than the outer diameter of the second land.

With the above arrangement, a gap can be provided between an inner wall portion of the valve chamber in which the first land is slidable and the second land. Therefore, it becomes possible to utilize this gap as a communication passage through which the work oil is caused to flow.

Still preferably, at the time of the first rotational range, a return port communicated to the return oil passage is valve-closed by the first land.

With the above-described arrangement, at the time of the first rotational range, all work oil from both the first discharge port and the second discharge port can be fed to the feed oil passage. Accordingly, even when the rotational speed of the rotor in a low speed range, it is still possible to feed an appropriate amount of work oil to the work oil fed section.

Preferably, at the time of the second rotational range, a return port communicated to the return oil passage is valve-opened, and the first oil passage and the second oil passage are partitioned from each other.

With the above-described arrangement, it becomes possible to feed only the work oil from the first discharge port to the feed oil passage. Accordingly, in case in association with increase in the rotational speed of the engine and the rotational speed of the rotor, an amount of work oil from the first discharge port alone becomes sufficient to secure the required pressure, it is possible to communicate the work oil from the second discharge port to the return passage without feeding it to the first oil passage. Consequently, as the excess oil pressure can be reduced, there can be realized an oil supply apparatus that operates in an efficient manner.

Still preferably, at the time of the third rotational range, a return port communicated to the return oil passage is valve-opened, and the first oil passage and the second oil passage are communicated to each other.

With the above-described arrangement, even when the rotational speed of the rotor in a high speed range, a large amount of work oil can be fed to the work oil fed section and also an excess work oil in excess over the required amount can be communicated to the return oil passage. Accordingly, the excess oil pressure can be lessened, so that there can be realized an oil supply apparatus that operates in an efficient manner.

EMBODIMENTS OF THE INVENTION

1. Construction of Oil Supply Apparatus

Figure 1:
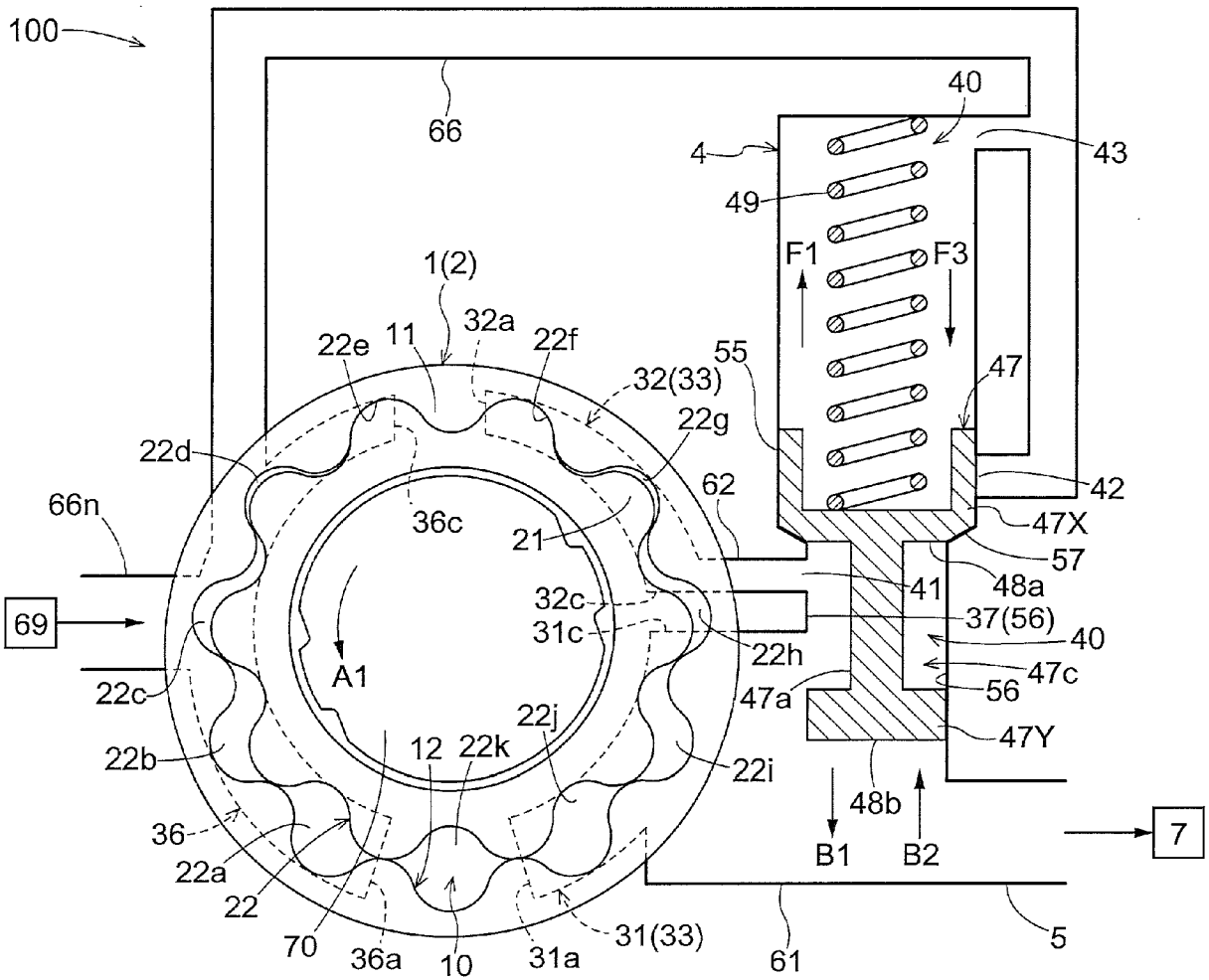
[FIG. 1] is a view schematically showing an oil supply apparatus.
Figure 2:
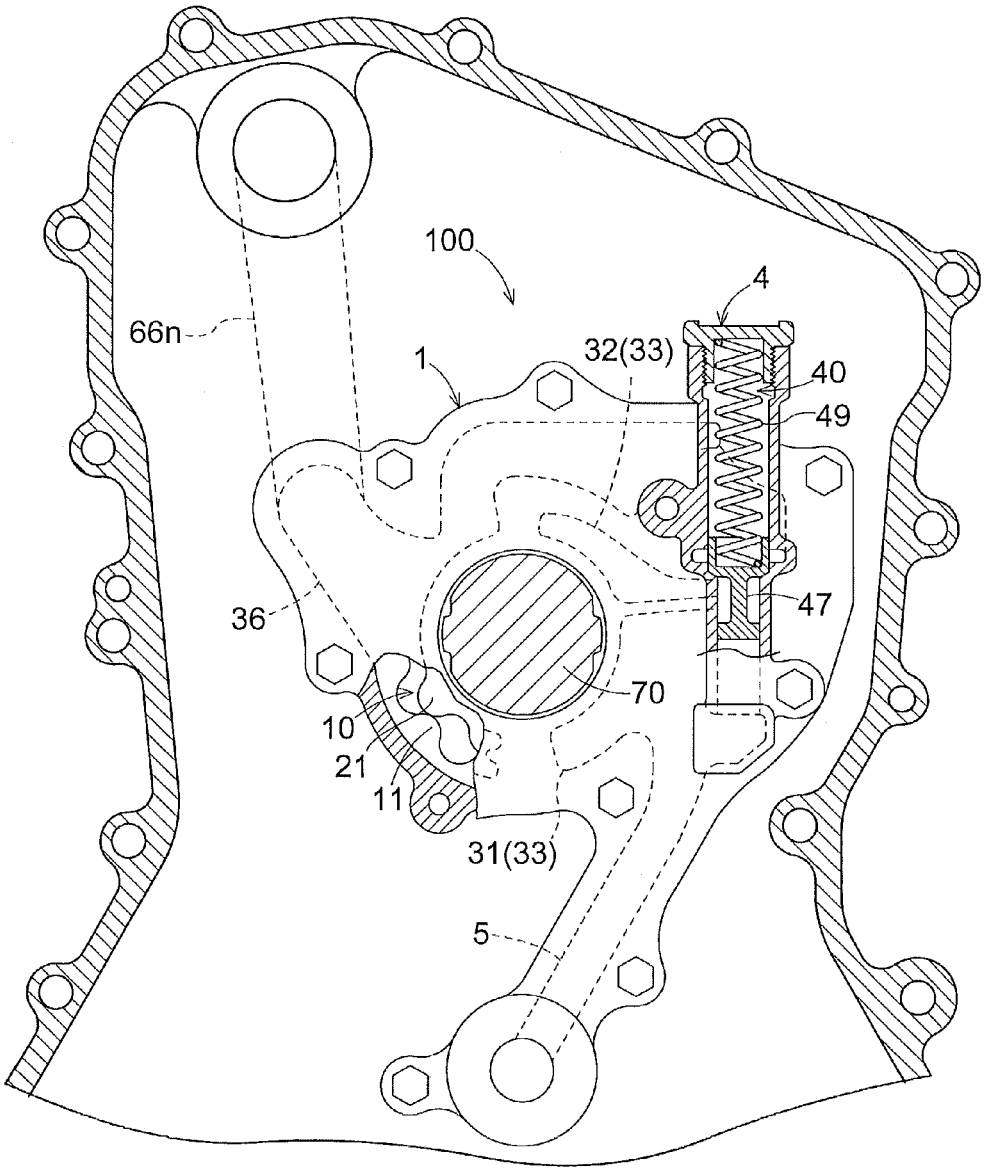
[FIG. 2] is a view showing an example in which the oil supply apparatus is applied to an engine of an automobile.

Next, embodiments of the present invention will be described in details. An oil supply apparatus 100 relating to the present invention has a function of feeding efficiently an amount of work oil to a work oil fed device ("a work oil fed section 7") in association with rotation of a rotor 2 which is driven in synchronism with a drive source such as a crank shaft of an automobile. FIG. 1 schematically shows the oil supply device 100. FIG. 2 shows the oil supply device 100 as being mounted in an engine of an automobile. As shown in FIG. 1 and FIG. 2, the oil supply apparatus 100 includes a pump body 1, a hydraulic control valve 4, an oil feed passage 5, a first oil passage 61, a second oil passage 62 and a return oil passage 66.

1-1. Pump Body

The pump body 1 is formed of metal (e.g. an aluminum alloy, an iron alloy, etc.) and a pump chamber 10 is formed inside this pump body 1. The pump chamber 10 forms an inner gear portion 12 constituting a driven gear having many inner teeth 11.

In the pump chamber 10, there is rotatably mounted a rotor 2 formed of metal. The rotor 2 is connected to a crank shaft 70 of the automobile engine as a drive source and is rotated in unison with the crank shaft 70. The rotational speed of the rotor 2 is designed to range e.g. from 600 to 7000 rpm approximately. The rotor 2 forms an outer gear portion 22 constituting a drive gear having many outer teeth 21. The inner teeth 11 and the outer teeth 21 are defined by a mathematical curve such as a trochoid curve, a cycloid curve, etc. The rotational direction of the rotor 2 is a direction denoted with an arrow A1. In association with rotation of the rotor 2, the outer teeth 21 of the rotor 2 come into engagement with the inner teeth 11 one after another, so that the inner gear portion 12 too is rotated in the same direction. The outer teeth 21 and the inner teeth 11 form therebetween gaps 22*a*-22*k*. In the condition shown in FIG. 1, the gap 22*k* has the largest volume and the gaps 22*e* and 22*f* have the smallest volume. Under this condition, with e.g. shifting from the gap 22*e* to the gap 22*a* in association with rotation of the rotor 2, the volume increases progressively, thereby to generate a suction pressure, whereby a suction effect for the work oil is obtained. Further, in association with rotation of the rotor 2, since the gaps 21*j*-22*f* have progressively smaller volumes, there is generated a discharge pressure, so that a discharge effect for the work oil is obtained.

The pump body 1 forms a discharge port group 33 including a first discharge port (a main discharge port) 31 and a second discharge port (an auxiliary discharge port) 32. That is, the discharge port group 33 comprises ports for discharging work oil from the pump chamber 10 in association with rotation of the rotor 2. The main discharge port 31 has end sides 31*a*, 31*c* and the auxiliary discharge portion 32 has end sides 32*a*, 32*c*. Further, the pump body 1 forms a suction port 36. The suction port 36 is a port for suctioning an amount of work oil into the pump chamber 10 in association with rotation of the rotor 2. The suction port 36 has end sides 36*a*, 36*c*.

In the instant embodiment, in the rotational direction denoted with the arrow A1, the suction port 36 is located at the start point and the main discharge port 31 is located upstream of the auxiliary discharge port 32. Further, the aperture area of the main discharge port 31 is set larger than the aperture area of the auxiliary discharge port 32. Incidentally, the area difference or area ratio between the aperture area of the main discharge port 31 and the aperture area of the auxiliary discharge port 32 is not particularly limited. Further, in case the aperture area of the main discharge port 31 and the aperture area of the auxiliary discharge port 32 are designed to be same as or different from each other, whichever one of the aperture area of the main discharge port 31 and the aperture area of the auxiliary discharge port 32 can be set larger than the other.

The main discharge port 31 and the auxiliary discharge port 32 are partitioned from each other by a partitioning portion 37, so that these ports have discharging functions independently of each other. Incidentally, respecting the width of the partitioning portion 37 (the length along the circumferential direction of the rotor 2), in case there occurs a rise of oil pressure during a compression process due to confining of work oil within the inter-teeth gaps between the inner teeth 11 and the outer teeth 12 in association with rotation of the rotor, it is advantageous if the width is formed narrower than the inter-teeth width positioned between the main discharge port 31 and the auxiliary discharge port 32.

1-2. Work Oil Feed Passage

The feed oil passage 5 is an oil passage for feeding work oil to the work oil fed section 7. The work oil fed section 7 can be e.g. a lubrication device needing oil feeding, such as a slide bearing, a bearing, etc., or a valve moving mechanism of an engine, a drive mechanism of the engine such as a cylinder, a piston, etc.

The first oil passage 61 is an oil passage connecting between the main discharge port 31 and the feed oil passage 5. Therefore, this passage has a function of feeding work oil discharged at least from the main discharge port 31 to the feed oil passage 5.

The second oil passage 62 is an oil passage for connecting a valve chamber 40 of the hydraulic control valve 4 to be described later and the auxiliary discharge port 32. Therefore, this passage has a function of feeding work oil discharged from the auxiliary discharge port 32 to the valve chamber 40. In this, the work oil discharged from the auxiliary discharge port 32 is fed via the valve chamber 40 and the first oil passage 61 to the feed oil passage 5.

The return oil passage 66 is an oil passage for returning work oil from the valve chamber 40 to at least one of the suction port 36 and an oil pan 69. In FIG. 1, the return oil passage 66 is shown in the form of returning the oil to the suction port 36.

Further, a passage 66*n* for suctioning work oil form the oil pan 69 is provided to be communicated to the suction port 36.

1-3. Hydraulic Control Valve

The hydraulic control valve 4 includes a valve body 47 operable in response to the oil pressure of the work oil fed to the feed oil passage 5 and the valve chamber 40 slidably accommodating this valve body 47. The valve body 47 is accommodated in the valve chamber 40 as being urged in a direction of an arrow B1 by a spring 49.

The valve body 47 includes two radially protruding portions that protrude along the radial direction of the valve body 47 about the axis of this valve body 47. These two radially protruding portions correspond to a first land 47X and a second land 47Y In the instant embodiment, the first land 47X and the second land 47Y are provided respectively in the form of cylinders coaxial with the valve body 47 and provided at opposed axial ends of the valve body 47. Further, the outer diameter of the first land 47X is set larger than the outer diameter of the second land 47Y. For realizing axially continuous connection between the first land 47X and the second land 47Y described above, the valve body 47 further includes a small-diameter portion 47*a* smaller than the outer diameters of the first land 47X and the second land 47Y. Therefore, the first land 47X, the small-diameter portion 47*a* and the second land 47Y together form an inter-land space 47*c*.

Further, the valve chamber 40 of the hydraulic control valve 4 includes a valve port 41, a return port 42 and a drain port 43. The valve port 41 is provided in a second inner wall portion 56 of the valve chamber 40 and communicated to the second oil passage 62. With this, it becomes possible to introduce work oil from the second discharge port 32 into the valve chamber 40. The return port 42 is provided in a first inner wall portion 55 of the valve chamber 40 and communicated to the return oil passage 66. With this, it becomes possible to return the work oil from the hydraulic control valve 4 to the suction port 36. The drain port 43 too is provided in the first inner wall portion 55 of the valve chamber 40 and communicated to the return oil passage 66. With this, as work oil is suctioned or discharged via the drain port 43 to/from the valve chamber 40, the valve body 47 can slide smoothly.

The outer diameter of the first land 47X is formed in correspondence with the inner diameter of the first inner wall portion 55 so that this first land 47X may slide along the inner peripheral face of the first inner wall portion 55 along the axial direction of the valve body 47. The outer diameter of the second land 47Y is formed in correspondence with the inner diameter of the second inner wall portion 56 so that this second land 47Y may slide along the inner peripheral face of the second inner wall portion 56 along the axial direction of the valve body47. In the instant embodiment, the outer diameter of the first land 47X is formed larger than the outer diameter of the second land 47Y as described above. For this reason, the inner diameter of the first inner wall portion 55 of the valve chamber 40 slidably accommodating the first land 47X is formed greater than the inner diameter of the second inner wall portion 56 of the valve chamber 40 slidably accommodating the second land 47Y. Incidentally, the above-described partitioning portion 37 constitutes a part of the second inner wall portion 56.

Specifically, preferably, the outer diameter of the first land 47X is formed e.g. about a few micro meters smaller than the inner diameter of the first inner wall portion 55. Further, preferably, the outer diameter of the second land 47Y is formed e.g. about a few micro meters smaller than the inner diameter of the second inner wall portion 56. Therefore, the first inner wall portion 55, the second inner wall portion 56, the first land 47X and the second land 47Y are set in the ascending order of the diameters thereof as the inner diameter of the first inner wall portion 55, the outer diameter of the first land 47X, the inner diameter of the second inner wall portion 56 and the outer diameter of the second land 47Y.

Also, between the first inner wall portion 55 and the second inner wall portion 56, an inner diameter varying portion 57 is formed. This inner diameter varying portion 57 is provided to continuously connect the first inner wall portion 55 and the second inner wall portion 56. Therefore, the valve body 47 accommodated in the valve chamber 40 while being urged by the spring 49 in the direction of arrow B1 is restricted by the inner diameter varying portion 57. With this, the valve body 47 establishes or break communication between the second oil passage 62 and either the first oil passage 61 or the return oil passage 66. The language "establish or brake" means realization of communication or non-communication therebetween. Therefore, the valve body 47 causes the second oil passage 62 to be communicated to the first oil passage 61 and the return oil passage 66 or causes the passage 62 not to be communicated thereto. Modes of such communication establishment or break between the second oil passage 62 and the first oil passage 61 and the return oil passage 66 will be detailed later. The inventive oil supply apparatus 100 is configured as described above.

2. Modes of Supply of Work Oil

With the oil supply apparatus 100 configured as described above, in association with increase in the rotational speed of the rotor 2, the valve body 47 of the hydraulic control valve 4 provides supply modes A-E to be described next. For facilitating understanding, in the following discussion, it is assumed that the rotational speeds of the rotor 2 are set as a first rotational range, a second rotational range and a third rotational range in the ascending order.

2-1. Supply Mode A

When the rotational speed of the rotor 2 is in a low speed range (e.g. up to 1500 rpm, for instance) such as the case with a situation immediately after startup of the engine, work oil is fed to the feed oil passage 5 by the oil pressure of the work oil of the first oil passage 61 discharged from the discharge port group 33. Such low speed range as above corresponds to the "first rotational range". In this situation, the oil pressure acts on an axially center face 48*a* of the first land 47X and a bottom 48*b* of the valve body 47. With this, there is generated a valve drive force F1 for driving the valve body 47 (see FIG. 1). If the valve driving force F1 is smaller than an urging force F3 of the spring 49 (F1<F3), then, the valve body 47 is moved in the arrow B1 direction by the spring 49 (FIG. 1). With this, the return port 42 communicated to the return oil passage 66 is valve-closed by the outer peripheral face of the first land 47X.

Figure 3:
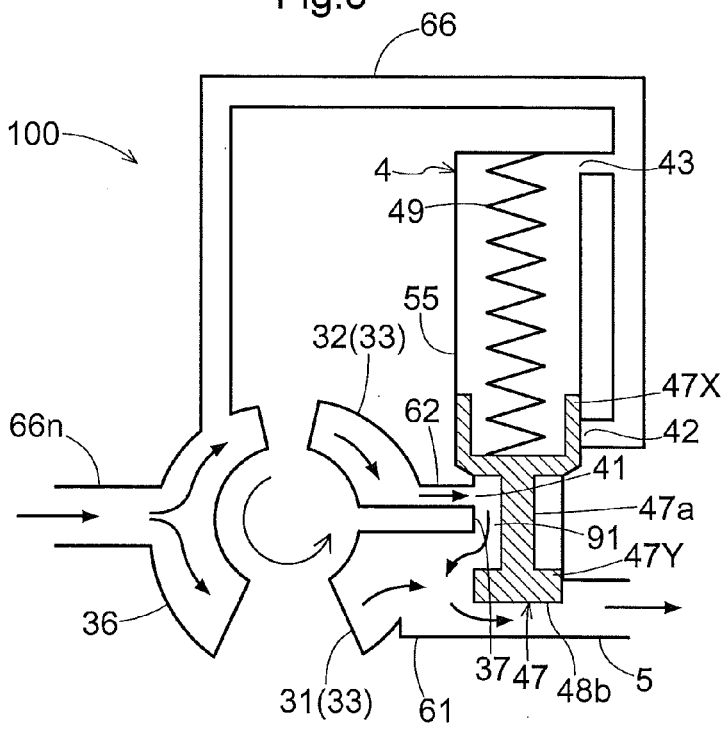
[FIG. 3] is a view schematically showing flow of work oil in case a rotor rotational speed is in a low speed range.

In the above, as shown in FIG. 3, the first land 47X of the valve body 47 valve-closes the return port 42 and also communication is established between the valve port 41 and the first oil passage 61. With this, the small-diameter portion 47*a* and the partitioning portion 37 together form a first communication passage 91. Accordingly, it becomes possible to feed the work oil from the auxiliary discharge port 32 via the small diameter portion 47*a*, that is, via the first communication passage 91, to the first oil passage 61.

Namely, in this supply mode A, the feeding amount of work oil to the feed oil passage 5 becomes the sum of the discharge mount of the main discharge port 31 and the discharge mount of the auxiliary discharge port 32. In this situation, the oil amount fed to the feed oil passage 5 exhibits a characteristics indicated by O-P line in FIG. 8; that is, in association with increase in the rotational speed of the rotor 2, the discharge amount of work oil from the main discharge port 31 increases and the oil pressure of the first oil passage 61 increases; and also the discharge amount of work oil from the auxiliary discharge port 32 increases and the oil pressure of the second oil passage 62 increases.

2-2. Supply Mode B

In association with increase in the rotational speed of the crank shaft 70 as a drive source of the engine, the rotational speed of the rotor 2 increases and this rotational speed of the rotor 2 exceeds a predetermined rotational speed (N1: e.g. 1500 rpm). This is a first intermediate speed range. In this first intermediate speed range, as the valve driving force Fl increases to overwhelm the urging force F3 of the spring 49 (F1>F3), the valve body 47 will be moved in the arrow B2 direction (see FIG. 1) until the valve driving force F1 becomes balanced with or equal to the urging force F3. This first intermediate speed range corresponds to the "second rotational range".

Figure 4:
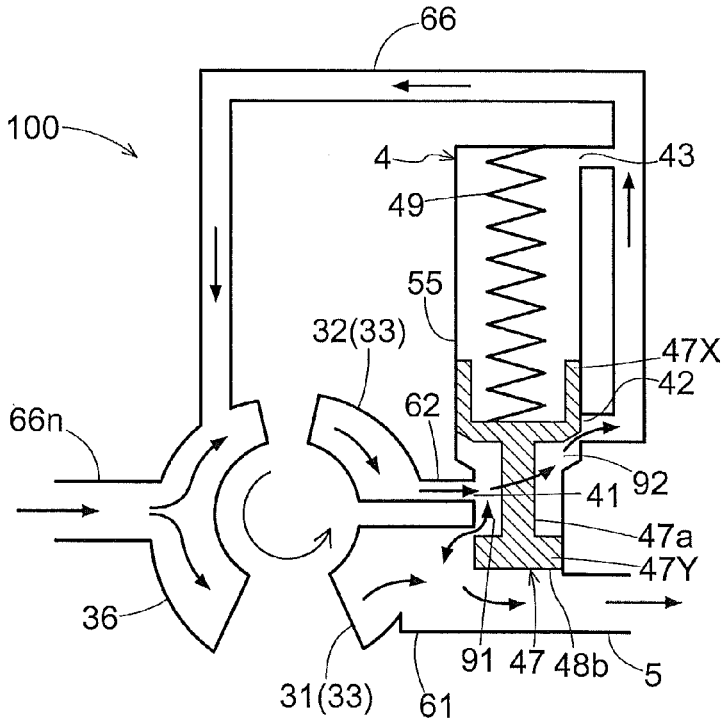
[FIG. 4] is a view schematically showing flow of work oil in case a rotor rotational speed is in a first intermediate range.

In the above situation, as shown in FIG. 4, the return port 42 communicated to the return oil passage 66 is valve-opened. Also, the communication between the valve port 41 and the first oil passage 61 is maintained. That is, there is provided an intermediate condition in the course of shifting of the valve body 47 to a supply mode D to be described below. With this, a second communication passage 92 is formed by the small-diameter portion 47*a* and the first inner wall portion 55. Therefore, it becomes possible to feed the work oil from the auxiliary discharge port 32 via the small-diameter portion 47*a*, that is, via the second communication passage 92, to the return oil passage 66. Further, a portion of the work oil from the main discharge port 31 too is fed via the first oil passage 91 to the return oil passage 66.

That is, in the case supply mode B, the feed amount of work oil to the feed oil passage 5 becomes a portion of the discharge amount of the main discharge port 31. In this situation, the oil amount fed to the feed oil passage 5 exhibits a characteristics indicated by P-Q line in FIG. 8. That is, as communication is established between the auxiliary discharge port 32 and the return oil passage 66, the ratio in the increase of the discharge amount in response to increase in the rotational speed of the rotor 2 becomes smaller.

Figure 8:
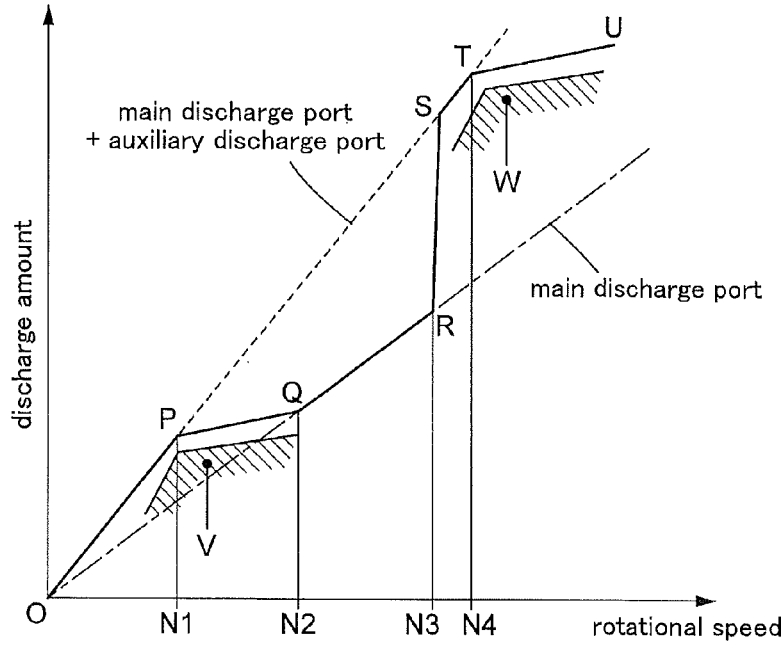
[FIG. 8] is a graph showing relationship between rotor rotational speeds and discharge amounts of work oil.

In the above, FIG. 8 shows the relationship between the required oil amounts of VVT (valve timing control apparatus) as the work oil fed section 7 and the rotor rotational speeds of the engine. For instance, immediate after startup of the engine, there is required an amount of oil comprising approximately the total discharge amount which is the sum of the discharge amount of the main discharge port 31 and the discharge amount of the auxiliary discharge port 32. But, when the rotor rotational speed exceeds the predetermined rotational speed (N1), such total discharge amount becomes unnecessary, and before long, the discharge amount of the main discharge port 31 alone will become sufficient to ensure the required oil amount (the region indicated by V in FIG. 8). Therefore, preferably, the oil supply apparatus 100 is configured such that the respective slopes of the characteristics curves O-P and. P-Q in FIG. 8 extend over the VVT required oil amount V. Incidentally, in this invention, the oil supply apparatus 100 may be alternatively configured that the slopes extend over the required oil amount of any other hydraulic actuator instead of or in addition to the above-described VVT required oil amount.

2-3. Supply Mode C

When the rotor rotational speed further increases to exceed N2 (e.g. 2500 rpm), the valve body 47 is further moved in the arrow B2 direction (see FIG. 1). This condition is specified as the "first intermediate speed range", which corresponds to the "second rotational range". With this, the first oil passage 61 and the second oil passage 62 are partitioned from each other by the partitioning portion 37 and the second land 47Y.

Figure 5:
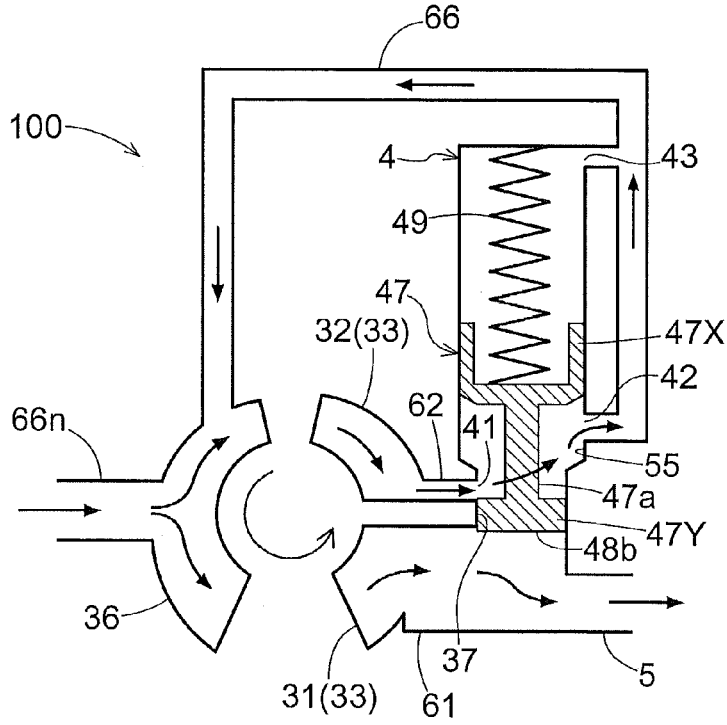
[FIG. 5] is a view schematically showing flow of work oil in case a rotor rotational speed is in a first intermediate range.

In the above situation, as shown in FIG. 5, communication between the valve port 41 and the first oil passage 61 is broken and also the valve closing of the return port 42 by the first land 47X of the valve body 47 is completely released. That is, when the oil pressure of the work oil to the feed oil passage 5 is greater than a predetermined range, the work oil from the main discharge port 31 is fed to the feed oil passage 5 and the work oil from the auxiliary discharge port 32 can be fed via the valve chamber 40 to the return oil passage 66. In this, the oil amount to be fed to the feed oil passage 5 exhibits a characteristics indicated by Q-R line in FIG. 8. That is, in the case of this supply mode C, the oil amount to the feed oil passage 5 becomes equal to the oil amount from the main discharge port 31.

2-4. Supply Mode D

When the rotor rotational speed further increases to exceed N3 (e.g. 4000 rpm), the valve body 47 is further moved in the arrow B2 direction (see FIG. 1). This condition is specified as "a second intermediate speed range", which corresponds to the "second rotational range".

Figure 6:
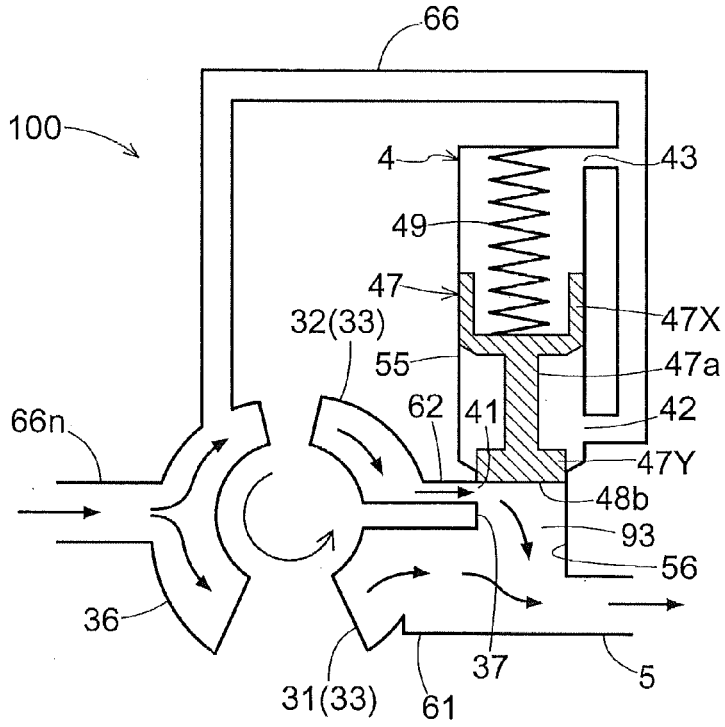
[FIG. 6] is a view schematically showing flow of work oil in case a rotor rotational speed is in a second intermediate range.

In the above situation, as shown in FIG. 6, communication is established between the valve port 41 and the first oil passage 61 and also the second land 47Y of the valve body 47 (the bottom portion 48*b* of the valve body 47) blocks feeding of work oil to the return port 42. Therefore, there is provided a situation wherein the second land 47Y blocks the second oil passage 62 relative to the return oil passage 66. Under this condition, a third communication passage 93 is formed by the bottom 48*b* of the valve body 47 and the second inner wall portion 56 of the valve chamber 40. Therefore, it becomes possible to feed the work oil from the auxiliary discharge port 32 to the first oil passage 61 via the third communication passage 93.

That is, in the case of this supply mode D, the feed amount of work oil to the feed oil passage 5 becomes again the sum of the discharge amount of the main discharge port 31 and the discharge amount of the auxiliary discharge port 32. In this, the oil amount to the feed oil passage 5 exhibits a characteristics indicated by R-T line in FIG. 8. That is, after communication is established between the valve port 41 and the first oil passage 61, the feeding of work oil to the return port 42 is stopped. So, the feeding destination of the work oil which has been fed so far to the return port 42 is now changed to the feed oil passage 5. Therefore, the feeding amount of work oil to the feed oil passage 5 increases (FIG. 8: R-S line) and thereafter the feeding amount becomes the sum of the discharge amount of the main discharge port 31 and the discharge amount of the auxiliary discharge port 32 (FIG. 8: S-T line).

2-5. Supply Mode E

When the rotational speed of the rotor 2 further increase to enter a high speed range over N4 (e.g. 4500 rpm), the valve body 47 is further moved in the arrow B2 direction (see FIG. 1),. This high speed range corresponds to the "third rotational range".

Figure 7:
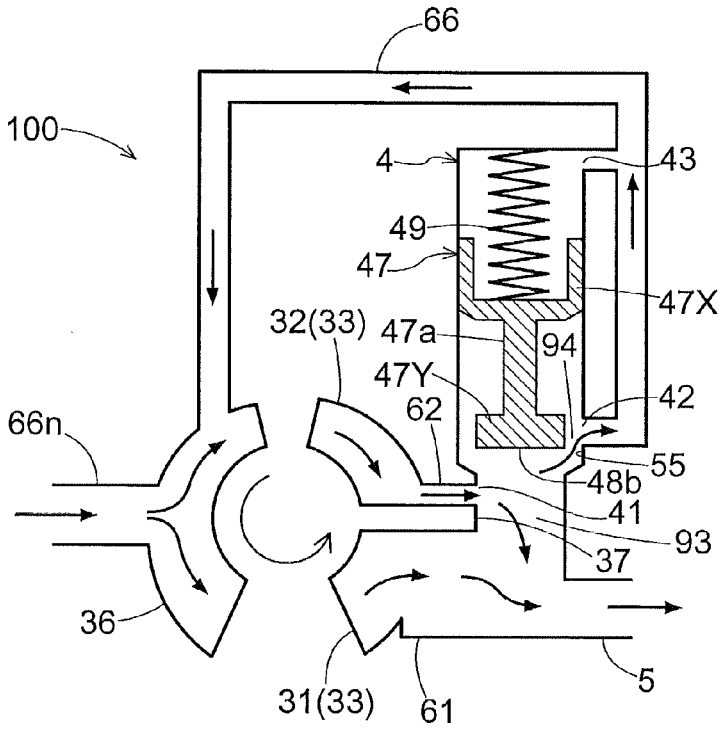
[FIG. 7] is a view schematically showing flow of work oil in case a rotor rotational speed is in a high speed range.

In the above situation, as shown in FIG. 7, the return port 42 communicated to the return oil passage 66 is valve-opened and communication is established between the first oil passage 61 and the second oil passage 62. With this, a fourth communication passage 94 is formed by the second land 47Y and the first inner wall portion 55. Accordingly, it becomes possible to feed a portion of the work oil from the main discharge port 31 and a portion of the work oil from the auxiliary discharge port 32 to the return oil passage 66 via the fourth communication passage 94. Incidentally, under this condition, the third communication passage 93 too is formed by the bottom 48*b* of the valve body 47 and the second inner wall portion 56. Therefore, as described above, after the communication of the second oil passage 62 to the return oil passage 66 is blocked by the second land 47Y, it becomes possible to feed the work oil from the auxiliary discharge port 32 to the first oil passage 61 also via the third communication passage 93.

That is, in the case of supply mode E, the feed oil amount becomes the sum of a portion of the discharge amount of the main discharge port 31 and a portion of the discharge amount of the auxiliary discharge port 32. In this situation, the feeding oil amount to the feed oil passage 5 exhibits a characteristics indicated by T-U line in FIG. 8. That is, as the route to the return oil passage 66 is communicated, the increase rate in the discharge amount relative to the increase in the rotational sped of the rotor 2 becomes smaller.

In this situation, FIG. 8 shows also the relationship between the required oil amounts for a piston jet as a work oil fed section 7 and the rotor rotational speeds. For instance, in the vicinity of high speed range of the rotor, there is required a total discharge amount comprising approximately the sum of the discharge amount of the main discharge port 31 and the discharge amount of the auxiliary discharge port 32. But, as the rotor rotational speed exceeds the predetermined rotational speed (N4), such total discharge amount becomes unnecessary. (the region indicated by W in FIG. 8). For this reason, preferably, the oil supply apparatus 100 is configured such that the slope of the characteristics curve T-U in FIG. 8 extends over the required oil amount W for the piston jet. Incidentally, in this invention, the oil supply apparatus 100 may be alternatively configured that the slope extends over the required oil amount of any other hydraulic actuator instead of or in addition to the above-described piston jet required oil amount.

In summary of the above, with the arrangement wherein the work oil from the auxiliary discharge port 32 can be fed via the first oil passage 61 to the feed oil passage 5 when the oil pressure of the work oil to the feed oil passage 5 is in a predetermined range, the feed amount of work oil to the feed oil passage 5 in this situation becomes the sum of the discharge amount of the main discharge port 31 and the discharge amount of the auxiliary discharge port 32 (FIG. 8: O-P line).

In case the rotational speed of engine and the rotational speed of the rotor 2 increase and the oil pressure of the work oil discharged from the main discharge port 31 becomes larger than the predetermined range and the work oil from the main discharge portion 31 alone becomes eventually sufficient to secure the required oil pressure of the feed oil passage 5, it becomes unnecessary to combine the work oil from the first oil passage 61 and the work oil form the second oil passage 62 (FIG. 8: P-Q line, Q-R line).

When the first oil passage 61 alone has become sufficient to secure the required oil pressure, the excess work oil in the second oil passage 62 may be returned to the return oil passage 66 without being fed to the feed oil passage 5. With this arrangement, the excess oil pressure can be lessened.

On the other hand, in the case of the work oil fed section 7 for e.g. a piston jet described above. it is necessary to speedily feed a large amount of work oil to the piston when the rotor rotational speed is in a high speed range.

For this reason, according to the present invention, an arrangement is provided such that when the oil pressure of work oil to the feed oil passage 5 is greater than a predetermined range, the work oil from the auxiliary discharge port 32 is fed via the third communication passage 93 to the feed oil passage 5. In this situation again, the feed amount of the work oil to the feed oil passage 5 may be the sum of the discharge amount of the main discharge port 31 and the discharge amount of the auxiliary discharge port 32 (FIG. 8: S-T line). With this, in the high speed range of the rotor rotational speed, it is again possible to increase the amount of work oil that can be fed, so that the required oil amount to be fed can be secured reliably. Thereafter, the feed oil amount becomes the sum of the discharge amount of the main discharge port 31 and the discharge amount of the auxiliary discharge port 32 (FIG. 8: S-T line).

3. Setting of Supply Modes 3-1. Setting of Point P

For instance, if the distance between the second oil passage 62 and the return port 42 along the axial direction of the valve chamber 40 is increased so as to delay the timing of feeding to the return oil passage 66, it is possible to set point P in FIG. 8 to the high rotational speed side along O-P line. On the other hand, for instance, if if the distance between the second oil passage 62 and the return port 42 along the axial direction of the valve chamber 40 is decreased so as to quicken the timing of feeding to the return oil passage 66, it is possible to set point P in FIG. 8 to the low rotational speed side along O-P line.

3-2. Setting of Point Q and Point R

By increasing the urging force of the spring 49, it is possible to set point Q and point R in FIG. 8 to the side for increasing the discharge amount. On the other hand, by decreasing the urging force of the spring 49, it is possible to set point Q and point R in FIG. 8 to the side for decreasing the discharge amount.

3-3. Setting of Point S and Point T

By increasing the axial length of the second land 47Y, it is possible to set point S and point T along the extension direction of S-T line to the side for increasing the discharge amount in FIG. 8. On the other hand, by decreasing the axial length of the second land 47Y, it is possible to set point S and point T along the extension direction of S-T line to the side for decreasing the discharge amount in FIG. 8.

By increasing the axial distance between the first land 47X and the second land 47Y, it is possible to set point S and point T along the extension direction of S-T line to the side for increasing the discharge amount in FIG. 8. On the other hand, by decreasing the axial distance between the first land 47X and the second land 47Y, it is possible to set point S and point T along the extension direction of S-T line to the side for decreasing the discharge amount in FIG. 8.

As described above, by varying settings of the various parts of the hydraulic control valve 4, the characteristics shown in FIG. 8 can be set appropriately. Therefore, since the characteristics can be set in accordance with the relationship between the discharge amount and the rotational speed, there can be realized an oil supply apparatus 100 suffering less pressure loss, thus achieving high efficiency.

The setting of point P, point S and point T can be varied also by varying the urging force of the spring 49, instead of or in addition to the above-described setting methods. For instance, by increasing the urging force of the spring 49, the point P, point S and point T can respectively be set to the high rotational speed side. By decreasing the urging force of the spring 49, the point P, point S and point T can respectively be set to the low rotational speed side.

With the inventive oil supply apparatus 100, with the two lands i.e. the first land 47X and the second land 47Y, communication states between the second oil passage 62 and the first oil passage 61 and the return oil passage 66 can be controlled. Therefore, in comparison with a valve body having three or more lands, compactization is possible. Further, since the total stroke length of the valve body 47 is shortened in correspondence with the compactization of the valve body 47, the oil supply apparatus 100 per se can be formed compact. Accordingly, there can be realized an oil supply apparatus 100 having good mountability.

[Other Embodiments]

In the foregoing embodiment, with reference to FIG. 1, it was explained that the return oil passage 66 is an oil passage for returning oil to the suction port 36. However, the application of the present invention is not limited thereto. Alternatively, the return oil passage 66 may be configured as an oil passage for returning work oil from the hydraulic control valve 4 to the oil pan 69 or as an oil passage for returning the work oil from the hydraulic control valve 4 to both the suction port 36 and the oil pan 69.

INDUSTRIAL APPLICABILITY

The present invention may be for use in e.g. lubrication of an automobile engine and controlling of a hydraulically controlled device.

DESCRIPTION OF REFERENCE MARKS/NUMERALS

1: pump body
2: rotor
4: hydraulic control valve
5: feed oil passage
7: work oil fed section
31: first discharge port (main discharge port)
32: second discharge port (auxiliary discharge port)
36: suction port
40: valve chamber
42: return oil passage
47: valve body
47*a*: small-diameter portion
47X: first land
47Y: second land
61: first oil passage
62: second oil passage
66: return oil passage
69: oil pan
70: crank shaft (drive source)
100: oil supply apparatus

The invention claimed is:

1. An oil supply apparatus comprising:

a pump body including a suction port for suctioning work oil in association with rotation of a rotor driven by a drive source, and a first discharge port and a second discharge port that discharge work oil in association with the rotation of the rotor;

a feed oil passage for feeding work oil to a work oil fed section;

a first oil passage for feeding at least work oil from the first discharge port to the feed oil passage;

a second oil passage for feeding work oil from the second discharge port to a valve chamber;

a return oil passage for returning work oil from the valve chamber to at least one of the suction port and an oil pan; and a hydraulic control valve having a valve body operable in response to an oil pressure of work oil fed to the feed oil passage for connecting and disconnecting the second oil passage to or from the first oil passage and the return oil passage;

wherein the valve body includes a first land and a second land that protrude along a radial direction of the valve body about an axis of the valve body, and a small diameter portion connecting the first land and the second land along an axial direction, the small diameter portion having a smaller diameter than at least an outer diameter of the first land and the second land;

rotational speeds of the rotor are set as a first rotational range, a second rotational range and a third rotational range in ascending order;

during the first rotational range, work oil from the second discharge port is fed via the small diameter portion to the first oil passage;

during the second rotational range, the work oil from the second discharge port is fed via the small diameter portion to the return oil passage;

during the third rotational range after the second oil passage is blocked relative to the return oil passage by the second land, the work oil from the second discharge port is fed to the first oil passage; and the work oil discharged from the second discharge port is capable of being fed to the feed oil passage without passing through the first discharge port.

2. An oil supply apparatus according to claim 1, wherein the outer diameter of the first land is larger than the outer diameter of the second land.

3. An oil supply apparatus according to claim 1, wherein during the first rotational range, a return port communicated to the return oil passage is closed by the first land of the valve.

4. An oil supply apparatus according to claim 1, wherein during the second rotational range, a return port communicated to the return oil passage is opened by the valve, and the first oil passage and the second oil passage are partitioned from each other.

5. An oil supply apparatus according to claim 1, wherein during the third rotational range, a return port communicated to the return oil passage is opened by the valve, and the first oil passage and the second oil passage are communicated to each other.

6. An oil supply apparatus according to claim 1, wherein the pump body includes a return port communicating with the return oil passage.

* * * * *